United States Patent [19]

Nakamura

[11] 4,353,195

[45] Oct. 12, 1982

[54] COIN PACKAGING APPARATUS CAPABLE OF SEPARATELY DISCHARGING PROPER COIN PACKAGES AND STRAY COINS

[75] Inventor: Minoru Nakamura, Himeji, Japan

[73] Assignee: Glory Kogyo Kabushiki Kaisha, Japan

[21] Appl. No.: 149,785

[22] Filed: May 14, 1980

[30] Foreign Application Priority Data

May 17, 1979 [JP] Japan ..... 54/66646[U]

[51] Int. Cl.[3] ..... B65B 57/14; B65B 57/20

[52] U.S. Cl. ..... 53/54; 53/212; 53/532

[58] Field of Search ..... 53/54, 58, 495, 52, 53/532, 212; 133/1 A, 8 A; 194/1 C, 1 D, 1 E, 1 F, DIG. 15

[56] References Cited

U.S. PATENT DOCUMENTS

| | | | |
|---|---|---|---|
| 2,278,436 | 4/1942 | Friend | 194/1 D X |
| 3,870,136 | 3/1975 | Voegeli | 194/1 D X |
| 3,874,144 | 4/1975 | Feigel | 53/53 |
| 4,058,954 | 11/1977 | Asami | 53/54 |
| 4,162,598 | 7/1979 | Watanabe et al. | 53/54 |
| 4,235,061 | 11/1980 | Watanabe et al. | 53/54 |

*Primary Examiner*—James F. Coan

*Attorney, Agent, or Firm*—Beveridge, Degrandi & Kline

[57] ABSTRACT

An apparatus for stacking each preassigned number of coins and packaging the coin stack with a wrapper strip. A selector plate is pivotally mounted at one of two exit openings of a discharge chute for the selective discharge of the proper coin packages and stray coins that may be produced during the transportation of each coin stack from stacking station to packaging station and during the subsequent packaging operation. The selector plate is pivotable between a first position for the discharge of the proper packages into one receptacle under one of the chute exit openings and a second position for the discharge of the stray coins into another receptacle under the other exit opening. The pivotal motion of the selector plate is electrically controlled in such a way that the selector plate is held in the second position at least during the time from the completion of each stacking operation to the completion of the packaging of the coin stack.

6 Claims, 8 Drawing Figures

COIN PACKAGING APPARATUS CAPABLE OF SEPARATELY DISCHARGING PROPER COIN PACKAGES AND STRAY COINS

BACKGROUND OF THE INVENTION

This invention relates to an apparatus for successively stacking a predetermined number of coins and packaging the successive stacks of coins. The invention is more specifically directed to improved means, in such a coin packaging apparatus, for separately discharging the correctly stacked and packaged coins and the stray or loose coins that may be produced during the transition of the stacked coins from stacking to packaging means and during the subsequent packaging thereof.

In the coin packaging apparatus of the type in question each preselected number of coins are successively dropped into and stacked in a tubular, upstanding, open-top stacking cylinder. The bottom end of this stacking cylinder is openably closed by a pair of coplanar gate plates movable into and out of contact with each other. The gate plates open upon completion of each stacking operation, thereby depositing the stack of coins on a coin carrier capable of vertical reciprocation. The coin carrier carries the coin stack down to the packaging station of the apparatus, where the coin stack is packaged with a strip of wrapper paper or the like.

One or more coins, however, may fall off the coin carrier when the coin stack is deposited thereon from the gate plates. Coins may also slide off the rest of the stack when it is being carried down to the packaging station, no matter how slowly and steadily the coin carrier is lowered to minimize the shock exerted on the coins. The coin packaging apparatus, as heretofore constructed, has allowed such stray coins to be chuted into the same receptacle as the proper packages of coins. It has therefore been necessary to manually divide the contents of the receptacle into the packaged and the loose coins.

SUMMARY OF THE INVENTION

An object of this invention is to provide an improved coin packaging apparatus capable of separately discharging proper coin packages and loose coins and hence to eliminate the manual labor heretofore required for separating the packaged and the unpackaged coins.

The coin packaging apparatus according to the invention comprises means for stacking each preselected number of coins, means for packaging each stack of coins transported from the stacking means, and discharge means receiving from the packaging means the successive proper packages of coins as well as stray coins produced during the transportation of the stacked coins from the stacking to the packaging means and during packaging operation. Characteristically, for the selective discharge of the proper coin packages and the stray coins, the discharge means is provided with selector means movable between a first working position for causing the discharge means to discharge the proper coin packages to a first discharge position and a second working position for causing the discharge means to discharge the stray coins to a second discharge position. Control means holds the selector means in the second working position at least during the time from the completion of the stacking of each preselected number of coins to the completion of the packaging of that coin stack.

Thus the selector means unfailingly directs toward the second discharge position all the stray coins produced during the transportation of the coin stack from the stacking to the packaging means and during the subsequent packaging of the coin stack. Any proper coin package can be discharged to the first discharge position as the selector means is moved to the first working position following the completion of the packaging operation. The loose coins recovered in the second discharge position may be immediately charged back into the apparatus for proper packaging.

The above and other objects, features, and advantages of this invention will become more apparent from a study of the following detailed description, in which reference is directed to the attached drawings.

DESCRIPTION OF THE PREFERRED EMBODIMENTS

General

Figure 1:
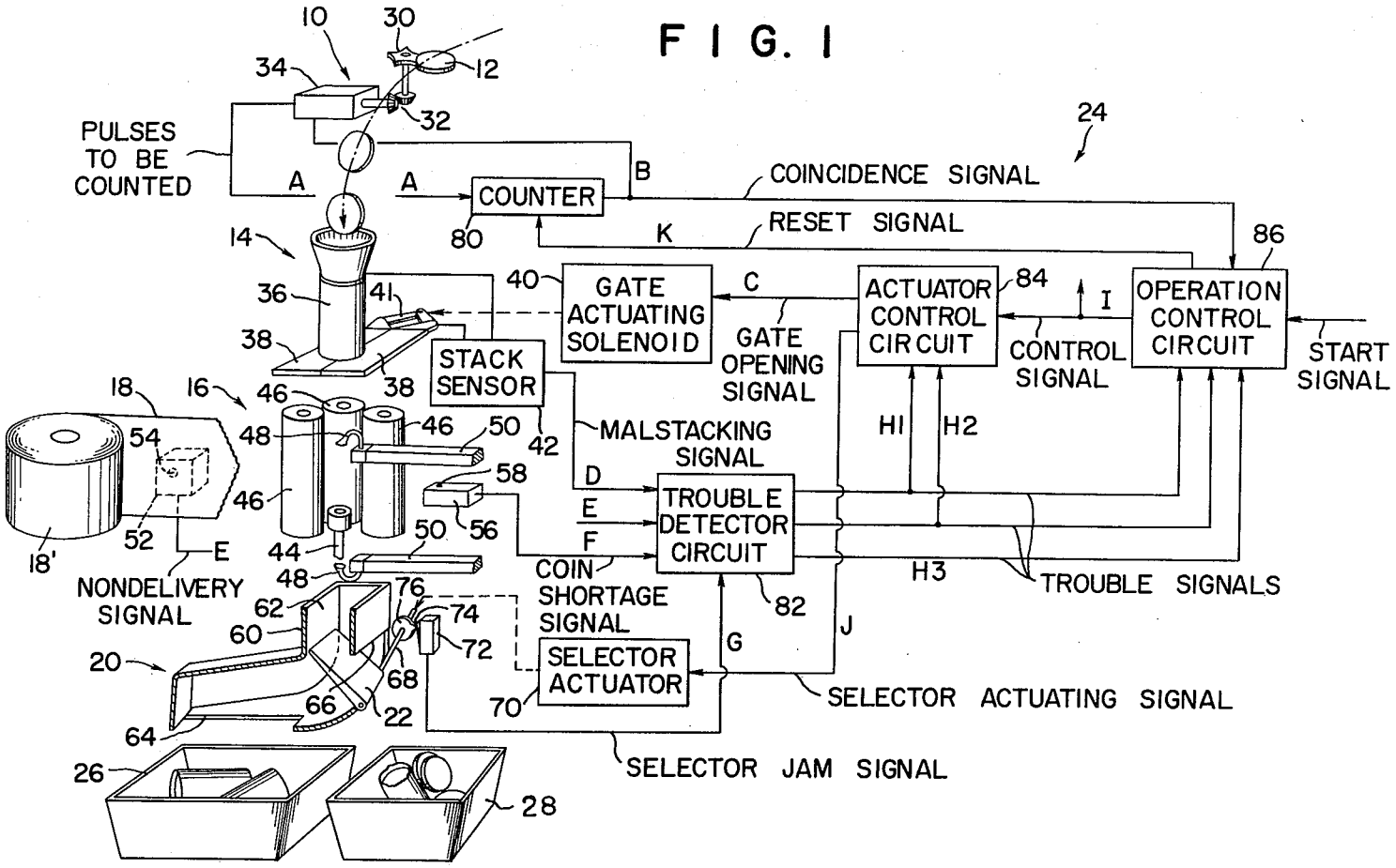
FIG. 1 is a schematic perspective view, partly sectioned for clarity, of the coin packaging apparatus incorporating the novel concepts of this invention, shown together with a block diagram of electric circuitry for controlling the operation of the apparatus.

Reference is first directed to FIG. 1 in order to describe the general organization of the illustrated coin packaging apparatus in accordance with the invention. The coin packaging apparatus broadly comprises:

1. a counting station 10 for counting coins 12 to be packaged as they pass successively therethrough and for preventing the passage of further coins each time a predetermined number of coins travel therethrough;
2. a stacking station 14 for stacking each preselected number of coins fed from the counting station 10;
3. a packaging station 16 for packaging the successive stacks of coins by wrapping a predetermined length of wrapper strip 18, as of cellophane or paper, around each stack and folding the opposite sides of the wrapper strip onto the ends of the stack;
4. a discharge station 20, including a selector plate 22, where proper packages of coins and loose or stray coins are discharged separately;
5. electric control circuitry 24 for controlling various working parts of the apparatus notably including the selector plate 22.

This invention is primarily, not exclusively, directed to the discharge station 20 with its selector plate 22. The control circuitry 24 actuates the selector plate 22 between its two predetermined working positions for effecting selective discharge of proper packages of coins and stray coins. Proper coin packages are chuted into a first receptacle 26, and stray coins into a second receptacle 28, as dictated by the position of the selector plate 22. Packages containing less than the preselected number of coins, due to the occurrence of the stray coins, are also directed into the second receptacle 28.

Given below are successive detailed discussions of the above listed stations 10, 14, 16 and 20 and control circuitry 24 of the coin packaging apparatus, followed by the description of its operation.

Counting Station

The counting station 10 includes a star wheel 30 arranged for engagement with the successive coins 12 as they are centrifugally expelled from a rotary infeed disc (not shown) into the passageway to the stacking station 14. Traveling past the star wheel 30 in engagement therewith, each coin 12 causes the star wheel to rotate a predetermined angle. Such rotation of the star wheel 30 is utilized, by means hereinafter set forth, for counting the number of coins being fed toward the stacking station 14, so that the star wheel will hereinafter be referred to as the counter wheel.

The counter wheel 30 is coupled via bevel gearing 32 to a pulse generator 34 which generates a train of pulses A representative of the coins 12 traveling past the counter wheel. As will be detailed later in connection with the control circuitry 24, the pulse generator 34 receives a coincidence signal B each time its output pulses reach the preselected number. In response to this coincidence signal the pulse generator 34 acts to lock the counter wheel 30 against rotation thereby preventing the delivery of further coins to the stacking station 14.

Stacking Station

For stacking each preselected number of coins 12 delivered from the counting station 10 as above, the stacking station 14 has a tubular, upstanding, open-ended stacking cylinder 36. The top end portion of the stacking cylinder 36 flares for receiving the coins 12, whereas its bottom end is openably closed by a pair of coplanar gate plates 38. Normally the gate plates 38 are sprung into abutting contact with each other to hold the bottom end of the stacking cylinder 36 closed. The stacking cylinder 36 has an inside diameter corresponding to the diameter of the coins to be packaged. Thus the successive coins 12 drop into the stacking cylinder 36 through its flaring top end and stack flatwise on the gate plate pair 38.

Shown in block form at 40 is a solenoid for opening the bottom of the stacking cylinder 36 after the unit number of coins 12 has stacked therein. The solenoid 40 acts on a toggle mechanism 41 to move the pair of gate plates 38 away from each other in response to a gate opening signal C to be referred to in the subsequent description of the control circuitry 24 and of the operation of the apparatus.

There may be a coin or coins that stand edgewise, instead of seating flatwise, in the stacking cylinder 36 during each stacking operation. A stack sensor 42 detects such "malstacking" of the coins from the height of the coin stack. The stack sensor 42 has one sensing electrode at the gate plate pair 38 and another sensing electrode at a prescribed height on the inside surface of the stacking cylinder 36.

Each unit number of coins will stack higher than usual in the stacking cylinder 36 if any one or more of the coins stand edgewise. This results in the activation of the stack sensor 42 via the pair of sensing electrodes. The stack sensor 42 on activation generates a malstacking signal D. The aforesaid gate opening signal C is also applied to the solenoid 40 when the stack sensor 42 puts out the malstacking signal D.

The malstacking of the coins could of course be detected photoelectrically, instead of by the sensing electrode pair. It is also possible to employ mechanical means for that purpose, such as a sensing rod arranged for movement into and out of the stacking cylinder 36 at a prescribed height from its bottom. The sensing rod will extend fully into the stacking cylinder 36 if all the coins are seated flatwise therein, and will not if any one or more coins stand edgewise.

Packaging Station

The packaging station 16 has a coin carrier 44 movable up and down for carrying the stack of coins from within the stacking cylinder 36 down to a predetermined packaging position. The coin stack deposits on the coin carrier 44 in its raised position when the pair of gate plates 38 move apart from each other to open the bottom of the stacking cylinder 36 upon completion of proper stacking operation. A suitable drive mechanism (not shown) subsequently lowers the coin carrier 44 at a speed sufficiently low to prevent the coin stack from collapsing. In the noted packaging position the middle of the coin stack with respect to its height approximately coincides with the middle of the wrapper strip 18 in its transverse direction.

When thus lowered to the packaging position, the coin stack is surrounded by three upstanding wrapping rolls 46. These wrapping rolls jointly rotate with the coin stack for wrapping the wrapper strip 18 therearound as the latter is fed from its roll 18'. In response to a timed control signal yet to be explained, an electric motor (not shown) imparts rotation to the wrapper strip roll 18' thereby causing same to pay off the wrapper strip 18.

The packaging station 16 further includes a pair of folder hooks 48 mounted on respective movable carrier arms 50. In response to the mentioned control signal the folder hook pair 48 acts to fold the opposite longitudinal edges of the wrapper strip onto the ends of the coin stack. The packaging of the coin stack is thus completed.

A wrapper sensor 52 has a microswitch 54 for sensing whether the wrapper strip 18 is being delivered to the wrapping rolls 46 or not. The wrapper sensor 52 puts out a nondelivery signal E when the delivery of the wrapper strip 18 ceases.

A coin shortage sensor 56 also has a microswitch 58 for sensing the possible shortage of coins, for reasons referred to presently, being packaged in the packaging station 16. When the folder hooks 48 fold the side edges of the wrapper strip onto the opposite ends of the coin stack, the upper folder hook will descend past the normal limit if less than the preselected number of coins are being packaged. The consequent undue descent of the upper folder hook carrier arm 50 results in the actuation of the microswitch 58 of the coin shortage sensor 56, whereupon the latter puts out a coin shortage signal F.

The above described three processing stations of the coin packaging apparatus can be largely conventional in construction, and therein lies no feature of the present invention.

Discharge Station

The discharge station 20 comprises a chute 60 for directing proper coin packages into the first receptacle 26 and stray coins, as well as packages containing less than the preassigned number of coins, into the second receptacle 28. The chute 60 has an entrance opening 62 just under the wrapping rolls 46 of the packaging station 16, a first exit opening 64 open to the first receptacle 26, and a second exit opening 66 open to the second receptacle 28.

The selector plate 22 is fixedly mounted on a rotatable shaft 68 at the second exit opening 66 of the chute 60, for pivotal movement between two working positions. In its first working position the selector plate 22 closes the second exit opening 66 and places the entrance opening 62 in communication with the first exit opening 64. In its second working position, as shown, the selector plate 22 opens the second exit opening 66 and blocks communication between entrance opening 62 and first exit opening 64.

The selector plate 22 is therefore to be held in the first working position when proper packages of coins are to be discharged. Falling by gravity from the packaging station 16 into the chute 60 through its entrance opening 62, the successive proper coin packages slide through the chute and fall into the first receptacle 26 through its first exit opening 64.

In accordance with a feature of the invention the selector plate 22 is to be retained in the second working position at least during that part of each packaging cycle which lasts from the completion of coin stacking operation to the completion of the packaging of the stacked coins. By the "completion of stacking operation" is meant the moment when the pair of gate plates 38 of the stacking station 14 start to open. The "completion of the packaging of the stacked coins" should be understood to signify the moment when the pair of folder hooks 48 complete the task of folding the side edges of the wrapper strip 18 onto the ends of the coin stack. Thus, during each such time, the selector plate 22 functions to drop into the second receptacle 28 any stray coins that may fall from the stacking station 14 or from the packaging station 16, as will be later explained in more detail.

A selector actuator 70 of any suitable design acts on the rotatable shaft 68 for shifting the selector plate 22 between its two working positions. The use of a spring or the like is recommended for holding the selector plate 22 in the illustrated second working position, so that the selector plate may be retained in the first working position only during the energization of the selector actuator 70.

Shown at 72 is a selector position sensor having a microswitch 74 for sensing the fact that the selector plate 22 is pivoted fully to the second working position when required. The microswitch 74 is activated by the lobe of a disc cam 76 fixedly mounted on the rotatable shaft 68 for simultaneous rotation with the selector plate 22. The selector position sensor 72 puts out a selector jam signal G if the selector plate 22 does not turn to the second working position when it should. It will be easy for the specialists to devise a suitable photoelectric sensing system that performs the same function as the illustrated means.

The jamming of the selector plate 22 will take place when: (1) a coin package or packages clog the first exit opening 64 of the chute 60; (2) coin packages fill up the first receptacle 26 and the chute 60; and (3) coin packages or loose coins are caught between the selector plate 22 and the opposed wall of the chute 60.

Control Circuitry

The control circuitry 24 of the illustrated coin packaging apparatus includes a counter 80 connected in circuit with the pulse generator 34 of the counting station 10. The counter 80 produces the afore-said coincidence signal B each time it receives the preselected number (e.g., 50) of the output pulses A from the pulse generator 34. The pulse generator 34 responds to the coincidence signal B to lock the counter wheel 30 against rotation, as has been mentioned.

A trouble detector circuit 82 has its inputs connected to the stack sensor 42, wrapper sensor 52, coin shortage sensor 56, and selector position sensor 72. The trouble detector circuit 82 produces three trouble signals H1, H2 and H3 in response to the output signals from the sensors 42, 52, 56 and 72. The first trouble signal H1 corresponds to the malstacking signal D from the stack sensor 42. The second trouble signal H2 corresponds to the nondelivery signal E from the wrapper sensor 52 and to the coin shortage signal F from the coin shortage sensor 56. The third trouble signal H3 corresponds to the selector jam signal G from the selector position sensor 72.

An actuator control circuit 84 has its input connected to the trouble detector circuit 82 for receiving the first H1 and second H2 trouble signals therefrom. The outputs of the actuator control circuit 84 are connected to the gate actuating solenoid 40 and to the selector actuator 70. In response to the first trouble signal H1 the actuator control circuit 84 delivers the gate opening signal C to the solenoid 40 thereby causing same to open the bottom of the stacking cylinder 36. Thus the stacking cylinder drops the wrongly stacked coins into the second receptacle 28 through the second exit opening 66 of the chute 60.

Further, in response to the control signal I from an operation control circuit 86 to be described subsequently, the actuator control circuit 84 delivers a selector actuating signal J to the selector actuator 70 thereby causing same to turn the selector plate 22 from the second to the first working position. The actuator control circuit 84 does not put out the selector actuating signal J at the required time, however, in event it receives the second trouble signal H2 from the trouble detector circuit 82. The selector plate 22 therefore remains in the second working position upon production of the nondelivery signal E by the wrapper sensor 52 and of the coin shortage signal F by the coin shortage sensor 56.

The operation control circuit 86 produces, in response to a start signal, the timed control signal I to actuate the various motors and solenoids of the apparatus for its proper operation. An input of the operation control circuit 86 is connected to the counter 80 for receiving the coincidence signal B therefrom. Upon reception of the coincidence signal B the operation control circuit 86 causes the actuator control circuit 84 to deliver the gate opening signal C to the solenoid 40 thereby causing the solenoid to open the bottom of the stacking cylinder 36.

As the coin carrier 44 subsequently lowers the coin stack from stacking station 14 to packaging station 16, the operation control circuit 86 causes the actuator control circuit 84 to deenergize the solenoid 40. Thus the pair of gate plates 38 move back into abutting contact with each other to reclose the bottom of the stacking cylinder 36. Simultaneously the operation control circuit 86 delivers a reset signal K to the counter 80 for resetting same. The operation control circuit 86 proceeds to cause the counting station 10 to resume the counting and infeeding of the next group of coins to be packaged.

The operation control circuit 86 is further connected to the outputs of the trouble detector circuit 82 for receiving the three trouble signals H1, H2 and H3 therefrom. If the trouble signals H1 and H2 are not input by the time of the completion of the coin packaging operation at the packaging station 16, the operation control circuit 86 causes the actuator control circuit 84 to deliver the selector actuating signal J to the selector actuator 70. Consequently the selector plate 22 turns from the second to the first working position, with the result that the proper coin package falls through the chute 60 into the first receptacle 26. The operation control circuit 86 causes the actuator control circuit 84 and selector actuator 70 to pivot the selector plate 22 from the first back to the second working position either upon lapse of a preassigned time or upon confirmation of the falling of the coin package into the first receptacle 26.

Upon reception of the third trouble signal H3 from the trouble detector circuit 82, the operation control circuit 86 immediately suspends the operation of the coin packaging apparatus. If the third trouble signal is input during the operation of the packaging station 16, the operation control circuit 86 sets the apparatus out of operation after the completion of the packaging operation.

Operation

Although the operation of this coin packaging apparatus is believed to be apparent from the foregoing description, further amplification will be made in the following brief summary of such operation. Traveling past the counter wheel 30, the successive coins 12 fall into the stacking cylinder 36 until the counter 80 puts out the coincidence signal B. The preselected number of coins are thus stacked flatwise in the stacking cylinder 36.

Figure 2A:
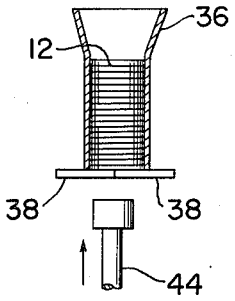
FIGS. 2A, 2B and 2C are a series of vertical sectional views, partly in elevation, explanatory of the way in which some of the stacked coins fall off the coin carrier when they are deposited thereon from the stacking means in the apparatus of FIG. 1.

As shown in FIG. 2A, the coin carrier 44 is raised and held in a prescribed standby position under the gate plate pair 38 under the control of the operation control circuit 86 before the gate plates open. Upon delivery of the coincidence signal B from the counter 80 to the operation control circuit 86, the actuator control circuit 84 impresses the gate opening signal C to the solenoid 40 thereby causing same to open the gate plate pair 38. Thereupon the stack of coins falls onto the coin carrier 44 which has been held standing by in its raised position.

Figure 2B:
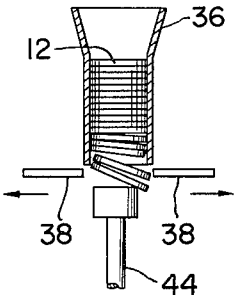
Figure 2C:
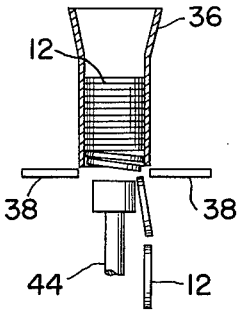

One or more lowermost ones of the stacked coins, however, may fall off the coin carrier 44, as pictured in FIGS. 2B and 2C, while the coin stack is being deposited from the gate plate pair 38 onto the coin carrier. Such loose coins fall through the packaging station 16 into the chute 60. Since the selector plate 22 is now in the illustrated second working position, the stray coins are thereby directed into the second receptacle 28 through the second exit opening 66 of the chute 60.

Figure 3A:
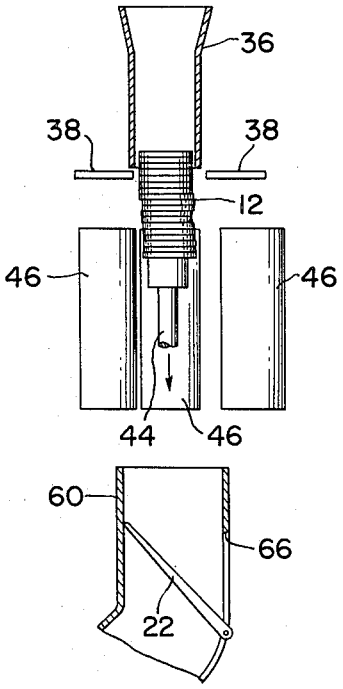
FIGS. 3A and 3B are a series of similar views also explanatory of the way in which some of the stacked coins fall off the rest of the stack when they are transported by the coin carrier from stacking to packaging means in the apparatus of FIG. 1.
Figure 3B:
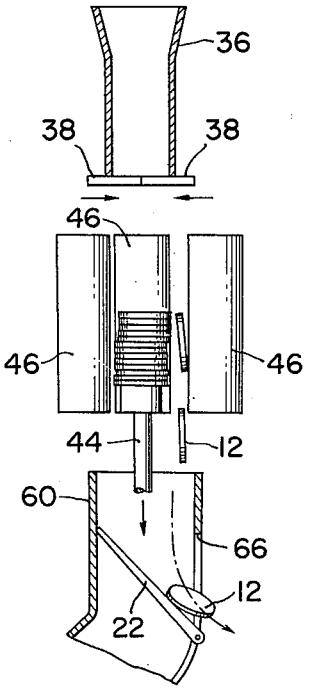

FIG. 3A shows a proper coin stack being lowered from stacking station 14 to packaging station 16 by the coin carrier 44. During this lowering operation, too, some coins may slip off the rest of the stack, due for example to the shock exerted by the coin carrier 44, as depicted in FIG. 3B. These loose coins also fall into the chute 60 and are directed by the selector plate 22 into the second receptacle 28.

In spite of such accidental falling of one or more coins, the rest of the coin stack is packaged in the usual manner with a predetermined length of the wrapper strip 18, severed from its roll 18' by a suitable cutter (not shown), at the packaging station 16. However, when the folder hook pair 48 folds the side edges of the wrapper strip onto the opposite ends of the coin stack, the coin shortage sensor 56 senses the shortage of the coins in the package and puts out the coin shortage signal F. The trouble detector circuit 82 delivers the trouble signal H2 to the operation control circuit 86 in response to the coin shortage signal F. Thereupon the operation control circuit 86 functions to set the apparatus out of operation after making it ready for the next cycle of packaging operation.

The package containing less than the preselected number of coins is dropped into the second receptacle 28 as guided by the selector plate 22 in its second working position. The apparatus can be set into operation for the next packaging cycle as the operation control circuit 86 receives the start signal.

If all the desired number of coins are stacked and packaged properly, the operation control circuit 86 causes the actuator control circuit 84 to put out the selector actuating signal J upon completion of the packaging operation. The selector actuator 70 shifts the selector plate 22 from the second to the first working position in response to the selector actuating signal J. Thus, upon retraction of the folder hook pair 48 and the coin carrier 44, the proper coin package falls into the chute 60 and is thereby guided into the first receptacle 26. Then, as dictated by the operation control circuit 86, the actuator control circuit 84 terminates the delivery of the selector actuating signal J to the selector actuator 70 thereby permitting the selector plate 22 to return from the first to the second position.

The selector plate 22 may not return to the second working position for any of the reasons listed previously. Thereupon the selector position sensor 72 delivers the selector jam signal G to the trouble detector circuit 82, and the latter delivers the corresponding trouble signal H3 to the operation control circuit 86. In response to this trouble signal the operation control circuit 86 suspends the counting and packaging operation of the apparatus pending the removal of the cause for the jamming of the selector plate 22.

It is clear from the foregoing description that all the stray coins that may be produced in this apparatus can be directed into the second receptacle 28 if the selector plate 22 is held in the illustrated second working position at least during the length of time from the completion of the stacking of each preselected number of coins to the completion of the packaging of the stacked coins. In the illustrated embodiment, however, the selector plate 22 is normally held in the second working position. The operation control circuit 86 causes the selector plate 22 to turn to the first working position, and to stay in that position for some definite length of time, following the completion of each packaging operation, provided that the trouble signals H1 and H2 are both not input by the time of the completion of the packaging operation.

Modifications

Figure 4:
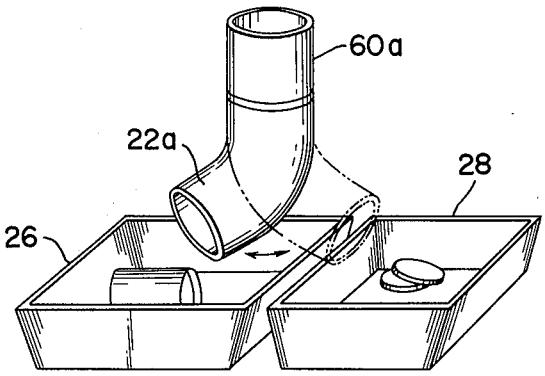
FIG. 4 is a perspective view of modified coin discharge and selector means for use in the apparatus of FIG. 1.

The selective discharge of proper coin packages and stray coins in accordance with the invention is possible by means other than the selector-plate-and-chute combination of FIG. 1. FIG. 4 illustrates an example of such alternative means, including a tubular chute 60*a* having a curved selector nozzle 22*a* rotatably mounted on its exit end. Proper coin packages are discharged into the first receptacle 26 when the selector nozzle 22*a* is in the solid line position. On being revolved through a preset angle to the phantom position, on the other hand, the selector nozzle 22*a* directs stray coins into the second receptacle 28 disposed side by side with the first receptacle 26.

Figure 5:
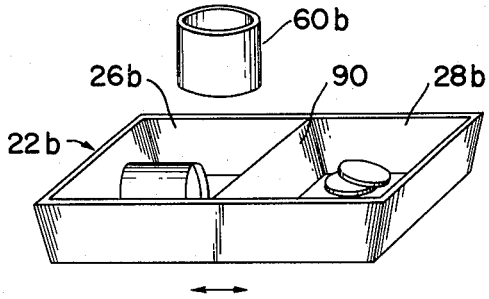
FIG. 5 is a perspective view of further modified coin discharge and selector means.

FIG. 5 shows further modified means, comprising a stationary chute 60*b*, with a single exit opening, and a selector receptacle 22*b* mounted under the chute for reciprocation in the horizontal direction. A partition 90 divides the interior of the selector receptacle 22*b* into a first section 26*b* and a second section 28*b*. The chute 60*b* drops proper coin packages into the first section 26*b* of the selector receptacle 22*b* when the latter is in the illustrated position with respect to the chute. When the selector receptacle 22*b* is moved a predetermined distance to the left, as viewed in FIG. 5, the chute 60*b* drops stray coins into its second section 28*b*.

Additional modifications and variations will occur to those skilled in the art without departing from the scope of this invention as set forth in the appended claims.

What is claimed is:

1. Apparatus for packaging a preselected number of coins in a stack comprising:

(a) means for stacking the preselected number of coins in a stack;

(b) means for packaging each stack of coins after stacking thereof by the stacking means;

(c) discharge means for receiving packaged coins, as well as stray coins, from the packaging means;

(d) selector means movable relative to the discharge means between a first working position in which the discharge means discharges to a first discharge position and a second working position in which the discharge means discharges to a second discharge position;

(e) control means normally maintaining the selector means in the second working position and responsive to the successful completion of the packaging of a stack of coins for moving the selector means to the first working position for a predetermined length of time and then returning the selector means to the second working position.

2. The coin packaging apparatus according to claim 1, wherein the discharge means comprises a chute, and wherein the selector means comprises a receptacle having a first and a second section and disposed under the chute for reciprocation between the first and the second working positions, the receptacle when moved to the first working position receiving in its first section the proper coin packages from the chute and, when moved to the second working position, receiving in its second section the stray coins from the chute.

3. The coin packaging apparatus according to claim 1, in which said control means includes sensing means for sensing the number of coins in the package being packaged by the packaging means, said sensing means responsive to the sensing of a shortage of coins in the sensed package for retaining the selector means in the second working position during the discharge of the package containing less than the preselected number of coins.

4. The coin packaging apparatus according to claim 1, further comprising means for sensing the position of the selector means with respect to the discharge means.

5. The coin packaging apparatus according to claim 1 or 4, wherein the discharge means comprises a chute having a first exit opening open to the first discharge position and a second exit opening open to the second discharge position, and wherein the selector means comprises a selector plate pivotally mounted on the chute for movement between the first working position, for opening the first exit opening and closing the second exit opening, and the second working position, for opening the second exit opening and closing the first exit opening.

6. The coin packaging apparatus according to claim 1, wherein the discharge means comprises a chute, and wherein the selector means comprises a curved selector nozzle mounted on the exit end of the chute for rotary movement between the first and the second working positions.

* * * * *